US009725151B2

(12) United States Patent
Hamamoto

(10) Patent No.: US 9,725,151 B2
(45) Date of Patent: Aug. 8, 2017

(54) AUTOMATIC STEERING DEVICE AND AUTOMATIC STEERING METHOD

(71) Applicant: FURUNO ELECTRIC CO., LTD., Nishinomiya, Hyogo (JP)

(72) Inventor: Kentaro Hamamoto, Nishinomiya (JP)

(73) Assignee: FURUNO ELECTRIC COMPANY LIMITED, Hyogo (JP)

( * ) Notice: Subject to any disclaimer, the term of this patent is extended or adjusted under 35 U.S.C. 154(b) by 112 days.

(21) Appl. No.: 14/377,678

(22) PCT Filed: Feb. 5, 2013

(86) PCT No.: PCT/JP2013/052625

§ 371 (c)(1),
(2) Date: Aug. 8, 2014

(87) PCT Pub. No.: WO2013/121935

PCT Pub. Date: Aug. 22, 2013

(65) Prior Publication Data

US 2016/0009351 A1 Jan. 14, 2016

(30) Foreign Application Priority Data

Feb. 14, 2012 (JP) ..... 2012-029883

(51) Int. Cl.
*B60L 3/00* (2006.01)
*B60L 15/00* (2006.01)
(Continued)

(52) U.S. Cl.
CPC ..... *B63H 25/04* (2013.01); *B63H 25/06* (2013.01); *B63H 25/36* (2013.01); *B63H 25/38* (2013.01)

(58) Field of Classification Search
None
See application file for complete search history.

(56) References Cited

U.S. PATENT DOCUMENTS 5,235,927 A 8/1993 Singh et al.
5,509,369 A * 4/1996 Ford ..... B63H 21/265 114/150
2007/0162207 A1* 7/2007 Shimo ..... G05D 1/0206 701/42

FOREIGN PATENT DOCUMENTS

JP S63-020292 A 1/1988
JP 3677274 B2 7/2005
JP 2011-189884 A 9/2011

OTHER PUBLICATIONS

International Search Report of the corresponding International Application No. PCT/JP2013/052625, dated May 14, 2013.

* cited by examiner

*Primary Examiner* — Lail Kleinman
(74) *Attorney, Agent, or Firm* — Global IP Counselors, LLP

(57) ABSTRACT

The automatic steering device comprises a target rudder angle calculating unit, a target rudder angle storage unit, and a steering command unit. The target rudder angle calculating unit calculates a target rudder angle of a steering based on a heading and a target course. The target rudder angle storage unit stores a target rudder angle at a time of a previous steering command. The steering command unit outputs a steering command for instructing the steering to steer based on a newest target rudder angle calculated by the target rudder angle calculating unit and the target rudder angle at the time of the previous steering command stored by the target rudder angle storage unit.

7 Claims, 9 Drawing Sheets

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B63H 25/04*** | (2006.01) |
| ***B63H 25/36*** | (2006.01) |
| ***B63H 25/06*** | (2006.01) |
| ***B63H 25/38*** | (2006.01) |

PRIOR ART

AUTOMATIC STEERING DEVICE AND AUTOMATIC STEERING METHOD

CROSS REFERENCE TO RELATED APPLICATIONS

This application is a U.S. National stage of International Application No. PCT/JP2013/052625 filed on Feb. 5, 2013. This application claims priority to Japanese Patent Application No. 2012-029883 filed on Feb. 14, 2012. The entire disclosure of Japanese Patent Application No. 2012-029883 is hereby incorporated herein by reference.

BACKGROUND

Field of the Invention

The present invention mainly relates to a configuration of an automatic steering device that is mounted on a movable body, such as a ship, etc.

Background Information

Ships during navigation are affected by external disturbances, such as waves and wind, and the posture of the hull is constantly changing. For this reason, in order to maintain a constant course (the direction in which the bow of the boat points), continuing to finely operate the rudder is necessary, which becomes a significant burden on the operator. Therefore, in order to automatically maintain a preset course, an automatic steering device for feedback control of the rudder is known. This kind of automatic steering device is disclosed, for example, Japanese Unexamined Patent Application Publication No. S63-20292, Japanese Patent No. 3,677,274, U.S. Pat. No. 5,235,927.

The configuration of a common automatic steering device will be explained with reference to FIG. 9. FIG. 9 shows a block diagram of an automatic steering system comprising a conventional automatic steering device 101.

This automatic steering device 101 can be attached to a hull 1 of a ship that is to be controlled. In addition to the automatic steering device 101, a steering 2 and a direction sensor 3 are provided to this hull 1.

The steering 2 comprises an appropriate rudder drive device (for example, a hydraulic cylinder, etc.) for changing the angle of the rudder (the rudder angle). The steering 2 is configured so that, when a prescribed steering command is received, the rudder angle (steering) is changed by driving the rudder drive device according to the steering command. By appropriately changing the rudder angle by driving the steering 2, the hull 1 to be controlled is turned according to necessity, and the bow (the nose) can be pointed in the desired direction. The direction sensor 3 is configured to detect the direction in which the bow of the hull 1 is facing (heading $\theta$). Additionally, a rudder angle sensor 4 that detects the actual angle of the rudder (the actual rudder angle $\delta_r$) is provided in the vicinity of the steering 2.

The actual rudder angle $\delta_r$ that is detected by the rudder angle sensor 4 and the heading $\theta$ detected by the direction sensor 3 are input into the automatic steering device 101. The automatic steering device 101 comprises a target course calculating unit 10, a target rudder angle calculating unit 11, and a steering command unit 12.

A set course $\theta_S$ that specifies the direction in which the hull 1 should progress is input into the target course calculating unit 10. This set course $\theta_S$ can be manually set by, for example, operating a setting knob. The target course calculating unit 10 calculates the target course $\theta_0$ based on the set course $\theta_S$.

The target rudder angle calculating unit 11 calculates the target rudder angle $\delta$, which is a rudder angle required to face the heading $\theta$ toward the target course $\theta_0$. This target rudder angle $\delta$ can be calculated with well-known control methods, such as a PID control, based on the course deviation angle $\Delta\theta$, which is the difference between the target course $\theta_0$ and the heading $\theta$, and the heading $\theta$.

This conventional automatic steering device 101 is configured to calculate the rudder angle deviation angle $\Delta\delta$, which is the difference between the target rudder angle $\delta$ and the actual rudder angle $\delta_r$. The steering command unit 12 outputs a steering command to the steering 2 to drive the steering 2 so that the rudder angle deviation angle $\Delta\delta$ will become zero (so as to match the actual rudder angle $\delta_r$ and the target rudder angle $\delta$). The steering 2 changes the rudder angle according to this steering command.

With the feedback control above, the heading $\theta$ can be turned to the set course $\theta_S$ by automatically correcting the rudder angle even if the posture of the hull 1 changes due to the effects of waves, wind, etc. Therefore, maintaining the course regardless of external disturbances, such as waves and wind, becomes easy, and the burden of the vessel operator can be greatly reduced.

SUMMARY

As described above, in a conventional automatic steering device 101, the rudder angle deviation angle $\Delta\delta$ was calculated based on the actual rudder angle $\delta_r$ detected by the rudder angle sensor 4. If the rudder angle deviation angle $\Delta\delta$ is not known, then "how much the steering 2 should be driven in which direction" will also not be known; as a result, the above-described control cannot be realized. Therefore, in the above-described conventional automatic steering device 101, to obtaining the rudder angle deviation angle $\Delta\delta$ is necessary. For this reason, conventional thought has been based on the notion that a rudder angle sensor 4 necessary for obtaining the rudder angle deviation angle $\Delta\delta$ was a necessary configuration in an automatic steering device.

Meanwhile, these types of automatic steering devices are often attached afterwards to the hull. However, not all hulls are made under the assumption that a rudder angle sensor will be introduced, meaning that there are some hulls to which attaching a rudder angle sensor is difficult. For example, a rudder angle sensor is disposed in the vicinity of the rudder (the stern); however, since the console (the operating panel) of an automatic steering device is often disposed in the center of the hull, routing the wiring from the rudder angle sensor to the console is necessary. However, depending on the hull, the above-described wiring can become difficult. In this kind of hull, employing a conventional automatic steering device that requires a rudder angle sensor is difficult. Additionally, there are cases in which a rudder angle sensor cannot be attached to the hull in the first place, so a conventional automatic steering device cannot be employed with such a hull.

The present invention was made in light of these circumstances, and the aim is to provide an automatic steering device that can omit a rudder angle sensor.

The object of the present invention to be achieved is as described; next, the means to achieve this object and the effects will be explained.

According to an aspect of the present invention, an automatic steering device with the following configuration will be provided. That is, this automatic steering device comprises a target rudder angle calculating unit, a target rudder angle storage unit, and a steering command unit. The target rudder angle calculating unit is configured to calculate a target rudder angle of the steering based on a heading and a target course of a movable body. The target rudder angle storage unit is configured to store the target rudder angle at a time of a previous steering command. The steering command unit is configured to output a steering command for instructing the steering to steer based on a newest target rudder angle calculated by the target rudder angle calculating unit and the target rudder angle at the time of the previous steering command stored by the target rudder angle storage unit.

In this way, by referring to the newest target rudder angle and the target rudder angle at the time of the previous steering command, how the target rudder angle has changed can be known. Also, in the case that the target rudder angle has not changed, a determination can be made that changing the rudder angle is not necessary; in the case that the target rudder angle has changed, a determination can be made that steering is necessary. Therefore, by controlling the steering based on this, an automatic steering control can be realized without detecting the current rudder angle with a rudder angle sensor.

In the above-described automatic steering device, when the target rudder angle change amount, which is a difference between the newest target rudder angle and the target rudder angle at the time of the previous steering command, is less than a prescribed steering threshold value, the steering command unit is preferably configured not to output the steering command.

In this way, in the case that the change in the target rudder angle is small, by not outputting a steering command, there is no need to frequently carry out fine steering and stable control can be performed.

This automatic steering device is preferably configured as described below. That is, the steering command unit includes a steering trigger output unit and a steering drive processing unit. The steering trigger output unit is configured to output a steering trigger when the target rudder angle change amount is greater than or equal to the steering threshold value. The steering drive processing unit is configured to output the steering command so as to drive the steering during a prescribed steering driving time in response to the steering trigger.

That is, the automatic steering device of the present invention does not operate a control based on the actual rudder angle, and there is the possibility that, if the rudder is moved a large amount at once, the device becomes unstable. Therefore, as described above, control is carried out by changing the rudder angle in a pulsed manner, so that the steering is driven only for a prescribed time every time a trigger is received. With this, the rudder angle can be prevented from changing a large amount at once, and the control can be stabilized.

In the above-described automatic steering device, the target rudder angle storage unit is preferably configured to update storage content to the newest target rudder angle in response to the steering trigger.

According to this, the storage content of the target rudder angle storage unit can be updated every time a steering command is output.

The above-described automatic steering device preferably further comprises a rudder angle keep command section configured to prohibit an output of a steering trigger in a direction to turn a rudder back.

That is, the automatic steering device of the present invention does not operate a control based on the actual rudder angle, so accurately matching the rudder to the rudder center angle is difficult. For this reason, if the rudder is turned back, there is the possibility that the rudder will go past the rudder center angle and that the rudder will be turned to the opposite side, resulting in the unnecessary turning of the rudder. Therefore, as described above, the unnecessary turning of the rudder as described above can be prevented by prohibiting driving the steering in the direction to turn back the rudder.

The automatic steering device above is preferably configured as described below. That is, this automatic steering device further comprises an update trigger output unit configured to output an update trigger when the steering trigger is prohibited in the direction to turn the rudder back by the rudder angle keep command section. Then, the target rudder angle storage unit is configured to update the storage content to the newest target rudder angle in response to the update trigger.

As mentioned above, the target rudder angle storage unit stores the target rudder angle at the time of the previous steering command. In the case that a steering trigger is prohibited, since a steering command will not be output, the storage contents of the target rudder angle storage unit will not be updated if left alone. Therefore, in the case that a steering trigger is prohibited, the storage contents of the target rudder angle storage unit are updated by outputting an update trigger separate from the steering trigger. With this, the steering can be more appropriately controlled.

This automatic steering device is preferably configured as described below. That is, this automatic steering device further comprises a traveling state determination unit configured to determine whether or not a traveling state of the movable body is in a straight traveling state. The rudder angle keep command section is configured to prohibit the output of the steering trigger in the direction to turn the rudder back when the movable body is in the straight traveling state.

In this way, unnecessary steering can be prevented by prohibiting steering in the direction to turn back the rudder when the movable body is moving straight.

This automatic steering device is preferably configured as described below. That is, this automatic steering device comprises a left-right balance detection unit and a left-right balance adjustment unit. The left-right balance detection unit is configured to detect deviation of a steering amount to the left and right based on a difference between an average value of the heading of the movable body and the target course. The left-right balance adjusting unit is configured to adjust based on the deviation the steering driving time when steering a rudder to the right and the steering driving time when steering the rudder to the left.

That is, depending on the individual differences in the steering, there are cases in which the manner of turning differs between the left and the right. Even in these cases, by adjusting the steering driving time between the left and the right as described above, the deviation of the steering amount to the left and the right can be corrected.

This automatic steering device is preferably configured as described below. That is, this automatic steering device further comprises a steering check unit and a steering driving time temporary adjustment unit. The steering check unit is configured to detect whether or not a rudder has moved based on a change in a turning angular velocity of the movable body. The steering driving time temporary adjustment unit is configured to temporarily increase the steering driving time when the rudder is not moving even though the steering trigger has been output.

With this, even when the rudder does not move for some reason, the rudder can be moved by increasing the steering driving time.

According to another aspect of the present invention, the following automatic steering method is provided. That is, this automatic steering method comprises a target rudder angle calculating step, a previous target rudder angle obtaining step, and a steering command step. In the target rudder angle calculating step, a target rudder angle of a steering is calculated based on a heading and a target course of a movable body. In the previous target rudder angle obtaining step, the target rudder angle at a time of a previous steering command is obtained. In the steering command step, a steering command for instructing the steering to steer is output based on a newest target rudder angle calculated in the target rudder angle calculating step and the target rudder angle at the time of the previous steering command obtained in the previous target rudder angle obtaining step.

In the above-described automatic steering method, in the steering command step, the steering command is preferably not output when the target rudder angle change amount, which is a difference between the newest target rudder angle and the target rudder angle at the time of the previous steering command, is less than a prescribed steering threshold value.

In the above-described automatic steering method, the steering command step preferably includes a steering trigger output step and a steering driving process step. In the steering trigger output step, a steering trigger is output when the target rudder angle change amount is greater than or equal to the steering threshold value. In the steering driving process step, the steering command is output so as to drive the steering during a prescribed steering driving time in response to the steering trigger.

BRIEF DESCRIPTION OF THE DRAWINGS

FIG. 2(*b*) is a diagram explaining the other state in which the rudder angle is changing in response to a steering trigger.

FIG. 3(*b*) is a diagram explaining the effect of a steering prohibiting command by the rudder angle keep command section.

FIG. 3(*c*) is a diagram explaining the effect of a steering prohibiting command by the rudder angle keep command section.

FIG. 4(*b*) is a diagram explaining how the turning angular velocity changes due to steering.

DETAILED DESCRIPTION OF EMBODIMENTS

Figure 1:
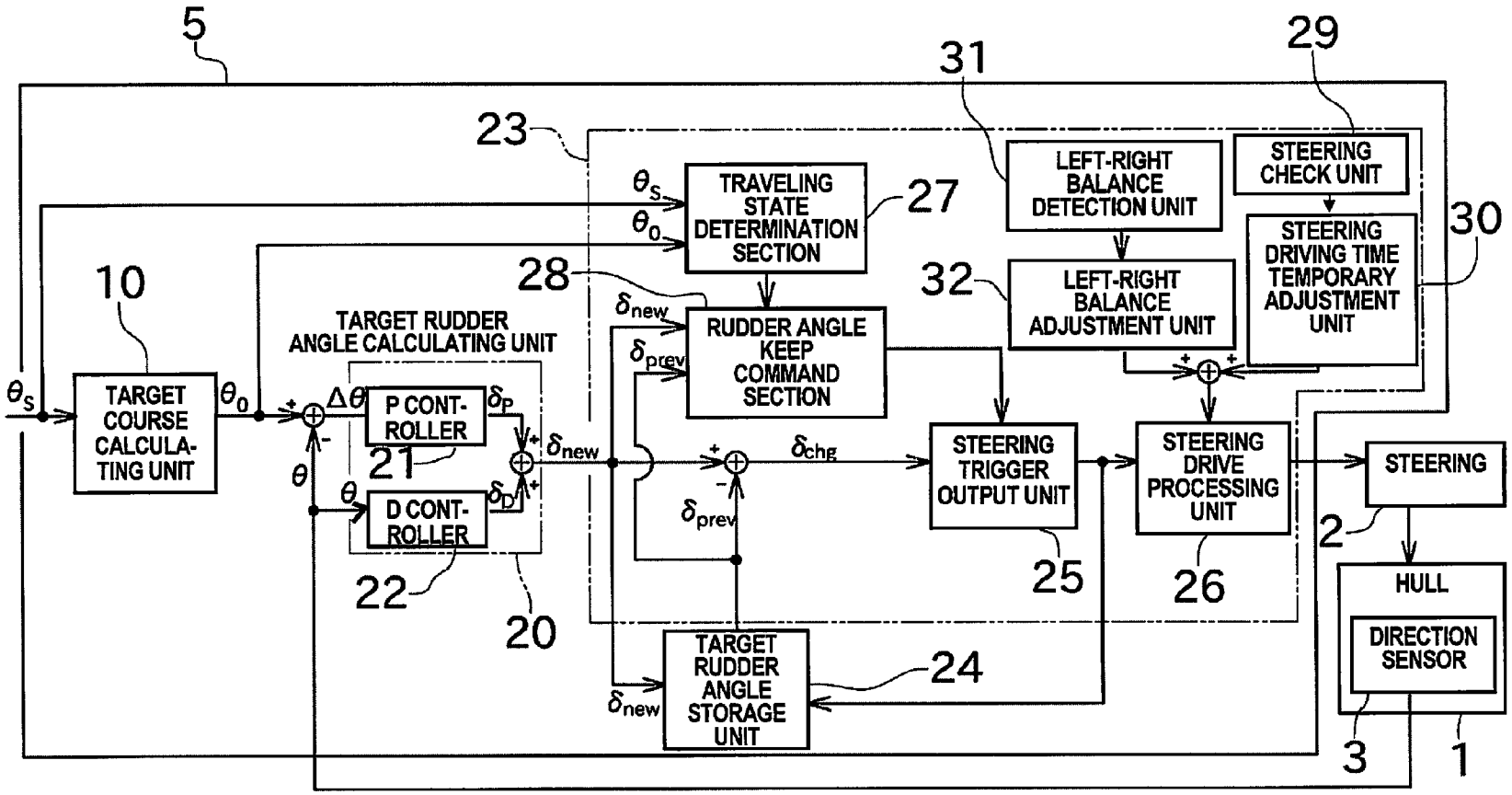
FIG. 1 is a block diagram showing a configuration of the automatic steering system comprising an automatic steering device according to one embodiment of the present invention.

Next, embodiments of the present invention will be explained with reference to the drawings. FIG. 1 shows a block diagram showing a configuration of the automatic steering system comprising the automatic steering device 5 according to the present invention.

This automatic steering system is provided in the hull 1 of the ship (the movable body) and automatically controls the rudder of the ship. The automatic steering system comprises an automatic steering device 5, a direction sensor 3, and a steering 2.

The direction sensor 3 detects the direction in which the bow (the nose) of the hull 1 is pointing (heading).

The steering 2 comprises an appropriate rudder drive device (for example, a hydraulic cylinder, etc.) for changing the angle of the rudder (the rudder angle). The steering 2 is configured so that, when a prescribed steering command is received, the rudder angle is changed at nearly a constant angular velocity in the direction specified by the steering command. Additionally, the steering 2 is configured to maintain the current rudder angle when a steering command is not input. Meanwhile, in the explanation below, the phrase "turn the rudder forward" indicates changing the rudder angle in a direction away from the rudder center angle, and the phrase "turn the rudder back" indicates changing the rudder angle in a direction toward the rudder center angle. Also, when discussing moving the rudder without specifying whether the rudder approaches or moves away from the rudder center angle, the description may be simply refer to "steering."

Figure 9:
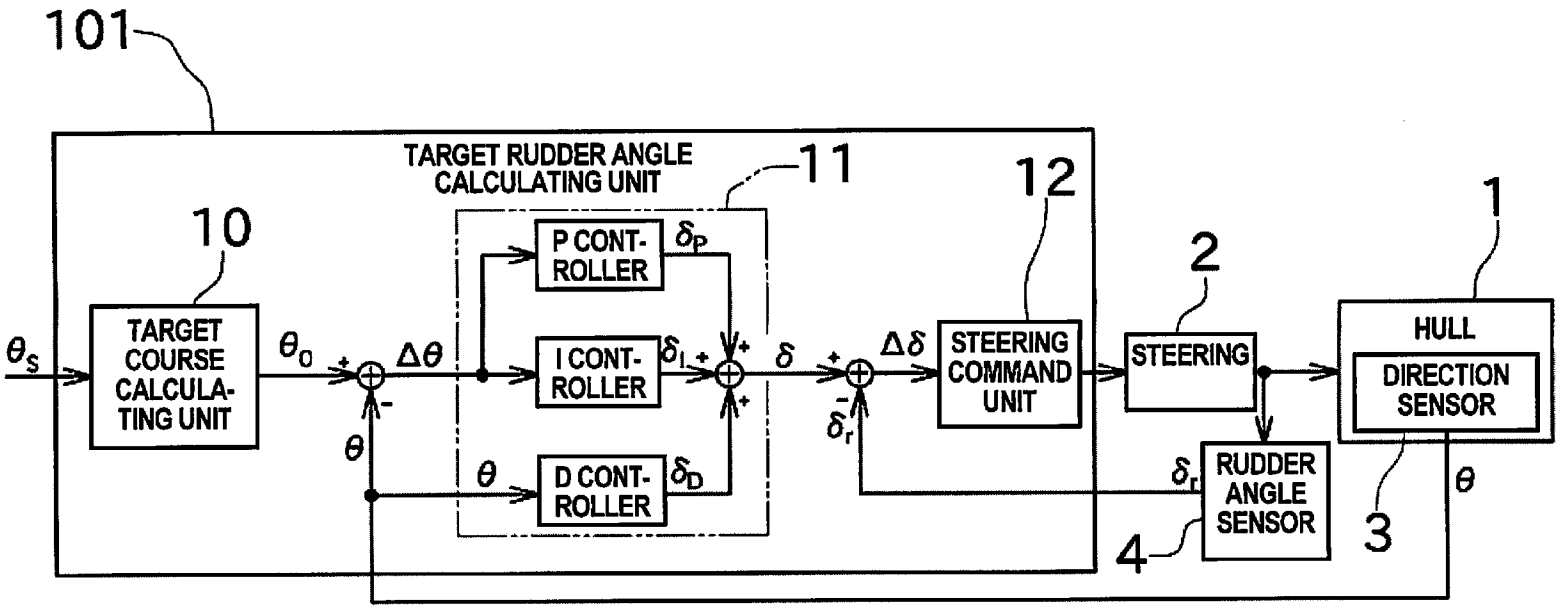
FIG. 9 is a block diagram showing a configuration of the automatic steering system comprising a conventional automatic steering device.

One feature of the automatic steering systems of the present embodiment is that the rudder angle sensor 4 that comprised a conventional automatic steering system has been omitted (FIG. 9). Since the rudder angle sensor 4 can be omitted in this way, the automatic steering device 5 of the present embodiment can be easily used on a hull to which attaching a rudder angle sensor is difficult.

The configuration of the automatic steering device 5 of the present embodiment will be explained in detail below. The automatic steering device 5 comprises a target course calculating unit 10, a target rudder angle calculating unit 20, a steering command unit 23, and a target rudder angle storage unit 24.

A set course $\theta_S$ that specifies the direction in which the hull 1 should progress is input into the target course calculating unit 10. This set course $\theta_S$ can be manually set by, for example, operating a setting knob. The target course calculating unit 10 is configured to calculate the target course $\theta_0$ based on the set course $\theta_S$. That is, in the case that the set course $\theta_S$ is constant, the target course calculating unit 10 outputs the set course $\theta_S$ that is set as the target course $\theta_0$ as is. Meanwhile, in the case that the set course $\theta_S$ is changed due to a setting operation by the user, etc., the target course calculating unit 10 gradually changes the output target course $\theta_0$ toward the new set course $\theta_S$. With this, even if the set course $\theta_S$ is greatly changed by a setting operation, etc., by the user, a rapid change of the target course $\theta_0$ can be prevented, and the operation can be stabilized. Meanwhile, the set course $\theta_S$ that is input to the target course calculating unit 10 can be configured so that the course is automatically set by a well-known navigation device mounted to the hull 1.

The target rudder angle calculating unit 20 is configured to calculate and output the target rudder angle. This target rudder angle is a rudder angle necessary to turn the heading $\theta$ to the target course $\theta_0$ (to bring the course deviation angle $\Delta\theta$ to zero). The target rudder angle is calculated by the well-known PD control based on the course deviation angle $\Delta\theta$ and heading $\theta$.

Specifically, the target rudder angle calculating unit 20 comprises a P controller 21 and a D controller 22. The P controller 21 calculates a proportional rudder angle $\delta_P$ by multiplying the proportional gain to the course deviation angle $\Delta\theta$. The D controller 22 calculates the change velocity (the differential quantity) of the heading $\theta$ and calculates a differential rudder angle $\delta_D$ by multiplying the differential gain with the above. Then, by adding the differential rudder angle $\delta_D$ and the proportional rudder angle $\delta_P$, the target rudder angle is obtained. Meanwhile, the above-described proportional gain and differential gain can be set beforehand, or they can be made to be an adaptive PD control, wherein the gains are automatically adjusted.

The calculation of the target rudder angle in the target rudder angle calculating unit 20 is conducted repeatedly as a prescribed calculation cycle. That is, a new target rudder angle will be output one after the other at a prescribed calculation cycle. In the explanation below, the newest target rudder angle output by the target rudder angle calculating unit 20 may be called the "newest target rudder angle $\delta_{new}$."

Meanwhile, in a conventional automatic steering device, utilizing a PID control to calculate the target rudder angle was common; however, in the present embodiment, as described above, a PD control that omits the integral control is utilized. This is because, in the automatic steering device 5 of the present embodiment, steering is determined based on the change amount $\delta_{chg}$ of the target rudder angle (mentioned below); therefore, the rudder angle can be controlled more appropriately if the integral control has been omitted.

The steering command unit 23 is configured to output a steering command to the steering 2. This steering command specifies the direction in which the rudder angle is to be changed (whether to steer to the left or to the right). As mentioned above, the steering 2 is configured so that, when a steering command is input, the rudder angle is changed at nearly a constant angular velocity in the specified direction; when a steering command is not input, the current rudder angle is maintained. Therefore, the longer the time that a steering command is output to the steering 2, the greater the change in the rudder angle will be in the specified direction. In this way, by adjusting the time necessary to output the steering command to the steering 2, the change amount of the rudder angle (the steering amount) can be adjusted.

Meanwhile, in a conventional automatic steering device 101 (FIG. 9) the rudder angle deviation angle $\Delta\delta$ is calculated based on the actual rudder angle $\delta_r$ detected by the rudder angle sensor 4, and a steering command was output to the steering 2 based on the above. Therefore, if the rudder angle deviation angle $\Delta\delta$ is zero, since this means that the actual rudder angle $\delta_r$ matches the target rudder angle $\delta$, changing the rudder angle is not necessary. Therefore, in this case, a steering command is not output. In the case that the rudder angle deviation angle $\Delta\delta$ is not zero, the actual rudder angle $\delta_r$ is misaligned from the target rudder angle $\delta$; therefore, a steering command is output so that the misalignment will be resolved. In this way, in a conventional automatic steering device 101, a steering command was output based on the detected value of the rudder angle sensor 4.

However, since the automatic steering system of the present embodiment does not comprise a rudder angle sensor, a steering command cannot be output based on the rudder angle deviation angle $\Delta\delta$.

Therefore, in the present embodiment, the steering command unit 23 is configured to output a steering command based on the newest target rudder angle $\delta_{new}$ and the target rudder angle $\delta_{prev}$ at the time of the previous steering command.

Therefore, in the case that the difference between the newest target rudder angle $\delta_{new}$ and the target rudder angle $\delta_{prev}$ at the time of the previous steering command (the target rudder angle change amount $\delta_{chg}$) is zero, the newest target rudder angle $\delta_{new}$ has not changed since the previous steering command; as a result, changing the rudder angle is not necessary. Therefore, in this kind of case, a determination can be made that a steering command does not have to be output. On the other hand, in the case that the target rudder angle change amount $\delta_{chg}$ is not zero, the newest target rudder angle $\delta_{new}$ has changed since the previous steering command. Therefore, in this kind of case, changing the rudder angle to the direction to which the target rudder angle has been changed is preferable. The direction to which the target rudder angle has changed (whether the target rudder angle has been changed to steer to the left or to the right) can be determined based on the sign of the target rudder angle change amount $\delta_{chg}$ (positive or negative).

In this way, a determination can be made as to whether steering should or should not be carried out; if steering should be carried out, whether the vessel should be steered to the left or to the right based on the target rudder angle change amount $\delta_{chg}$ can be determined. Therefore, the automatic steering control can be realized by controlling the steering 2 based on this determination. In addition, this control does not at all require an output from a rudder angle sensor (the actual rudder angle). As described above, with a configuration in which a steering command is output based on the target rudder angle change amount $\delta_{chg}$, which is the difference between the newest target rudder angle $\delta_{new}$ and the target rudder angle $\delta_{prev}$ at the time of the previous steering command, an automatic steering control can be realized without utilizing a rudder angle sensor.

The automatic steering device 5 of the present embodiment comprises a target rudder angle storage unit 24 for storing the target rudder angle $\delta_{prev}$ at the time of the previous steering command. This target rudder angle storage unit 24 is configured to be able to store the target rudder angle that is calculated by the target rudder angle calculating unit 20. When a steering command is output, the target rudder angle storage unit 24 is configured to overwrite and update the storage content with the newest target rudder angle $\delta_{new}$ that is output by the target rudder angle calculating unit 20. Then, the target rudder angle storage unit 24 retains the current storage content until the next steering command is output. In this way, storing the target rudder angle $\delta_{prev}$ at the time of the previous steering command to the target rudder angle storage unit 24 is possible.

Next, the configuration of the steering command unit 23 will be explained in detail. The steering command unit 23 comprises a steering trigger output unit 25 and a steering drive processing unit 26.

The newest target rudder angle $\delta_{new}$ that is calculated by the target rudder angle calculating unit 20 is input to the steering command unit 23. The steering command unit 23 reads the target rudder angle $\delta_{prev}$ at the time of the previous steering command that is stored in the target rudder angle storage unit 24 every time the newest target rudder angle $\delta_{new}$ has been obtained, and this unit calculates the target rudder angle change amount $\delta_{chg}$, which is the difference between the newest target rudder angle $\delta_{new}$ and the target rudder angle $\delta_{prev}$ at the time of the previous steering command.

Figure 2A:
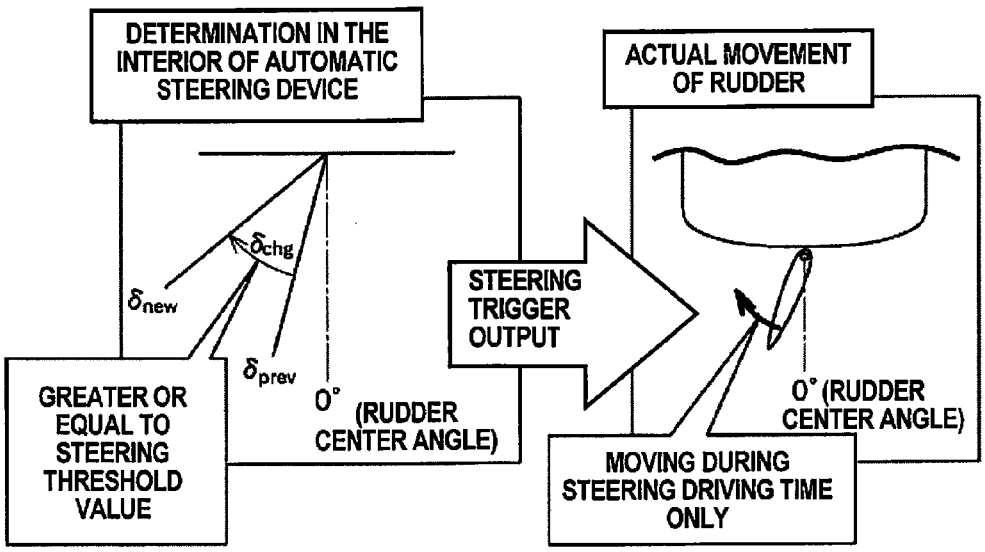
FIG. 2(*a*) is a diagram explaining the state in which the rudder angle is changing in response to a steering trigger.
Figure 2B:
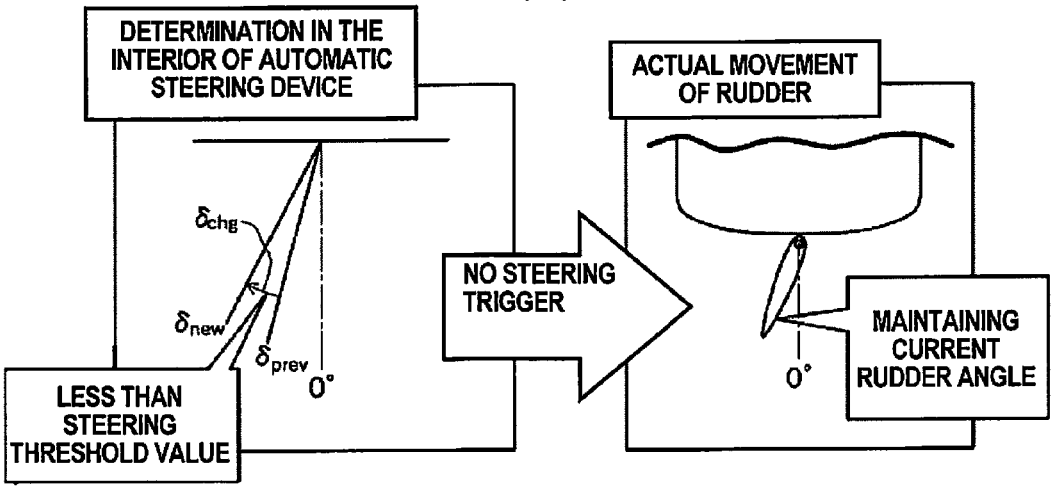

The target rudder angle change amount $\delta_{chg}$ is input into the steering trigger output unit 25. The steering trigger output unit 25 is configured to output a steering trigger when the (absolute value of the) target rudder angle change amount $\delta_{chg}$ is greater than or equal to a prescribed steering threshold value (FIG. 2(*a*)). This steering trigger includes information that specifies the direction to which the rudder angle is to be changed (whether to steer to the left or to the right). Meanwhile, as mentioned above, the direction to which the rudder angle is to be changed can be determined based on the sign of the target rudder angle change amount $\delta_{chg}$. Additionally, the steering trigger output unit 25 is configured to not output a steering trigger when the (absolute value of the) target rudder angle change amount $\delta_{chg}$ is less than the steering threshold value.

The steering trigger is input into the steering drive processing unit 26. When the steering trigger is input into the steering drive processing unit 26, a steering command that provides instructions for steering in a direction specified by the steering trigger is output to the steering 2. At this time, the steering drive processing unit 26 is configured to continue to output the steering command from the time that the steering trigger is input for the duration of the prescribed steering driving time. In the present embodiment, this steering driving time is configured to be a relatively short period of time (for example, several hundred milliseconds). In this case, the change amount of the rudder angle by one steering trigger will become relatively small (for example, a rudder angle change amount of around 1°).

Therefore, since the automatic steering device 5 of the present invention does not control a ship based on the actual rudder angle (the actual rudder angle), there is the possibility that, if the rudder is moved a large amount at once, the device will become unstable. Therefore, as described above, the device has been configured to change the rudder angle in a pulsed manner so that every time a steering trigger is received, the steering 2 is driven only for a prescribed steering driving time. With this, the rudder angle can be prevented from changing a large amount at once, and the control can be stabilized.

Additionally, as described above, the steering trigger output unit 25 of the present embodiment is configured to not output a steering trigger when the target rudder angle change amount $\delta_{chg}$ is less than a prescribed steering threshold value. Also, as mentioned above, the steering drive processing unit 26 will not output a steering command to the steering 2 when a steering trigger is not input. That is, the automatic steering device 5 of the present embodiment will not conduct steering and will maintain the current rudder angle when the target rudder angle change amount $\delta_{chg}$ is less than the steering threshold value (FIG. 2(*b*)). In this way, in the present embodiment, since steering is not conducted when the change in the target rudder angle is small, there is no need to frequently carry out fine steering and stable control can be performed.

The above-described steering trigger is also input into the target rudder angle storage unit 24. The target rudder angle storage unit 24 is configured to receive a steering trigger and to overwrite and update the storage content with the newest target rudder angle $\delta_{new}$. With this, the storage contents of the target rudder angle storage unit 24 can be updated every time that a steering command is output. In this way, storing the target rudder angle $\delta_{prev}$ at the time of the previous steering command to the target rudder angle storage unit 24 is possible.

Meanwhile, since the automatic steering device 5 of the present embodiment does not have a rudder angle sensor, this device cannot conduct a control in which the current rudder angle (the actual rudder angle) is accurately matched to the target rudder angle. However, even if the actual rudder angle is not accurately matched to the target rudder angle, if they are matched to a certain extent, the hull 1 will turn without problems. Therefore, even if the actual rudder angle cannot be accurately matched with the target rudder angle, carrying out the automatic steering control of the automatic steering device 5 of the present embodiment at a sufficient accuracy without any problems is possible.

Meanwhile, since the automatic steering device 5 of the present embodiment does not have a means to check whether or not the rudder has returned to the rudder center angle (the rudder angle sensor), accurately aligning the current rudder angle with the rudder center angle is difficult. For this reason, in the case a control for "bringing the rudder closer to the rudder center angle" in the configuration of the present embodiment, there is the possibility that the rudder will go past the rudder center angle and will be turned to the opposite side. In this way, when a target rudder angle is output with the aim of bringing the rudder closer to the rudder center angle but the rudder goes past the rudder center angle and is turned to the opposite side, this will be referred to as "unnecessary turning of the rudder" in the present Specification.

Unnecessary turning of the rudder, as described above, especially becomes a problem when the hull 1 is traveling straight. Additionally, when the hull 1 is traveling straight, since the rudder is basically positioned near the rudder center angle, the rudder will go past the rudder center angle even if the rudder moves only slightly. Therefore, the possibility is high that unnecessary turning of the rudder will be generated when the hull 1 is traveling straight.

Here, the steering command unit 23 of the present embodiment comprises a traveling state determination section 27 and a rudder angle keep command section 28 that prohibits the output of a steering trigger in the direction that turns back the rudder.

The traveling state determination section 27 is configured to determine the traveling state of the hull 1 (if traveling straight or turning, etc.). Any appropriate method can be used as the method of determining the traveling state. For example, in the traveling state determination section 27 of the present embodiment, the configuration is such that, when the set course $\theta_S$ input into the target course calculating unit 10 is greatly changed, a determination is made that the hull is turning. That is, when the set course $\theta_S$ is changed greatly, the steering 2 is controlled so that the heading $\theta$ is turned to the changed set course $\theta_S$, and the hull 1 makes a large turn. Therefore, when the set course $\theta_S$ is changed greatly, a determination can be made that the hull is in a turning state.

Whether or not the set course $\theta_S$ was greatly changed can be determined by looking at the difference between the set course $\theta_S$ and the target course $\theta_0$. That is, as mentioned above, the target course $\theta_0$ that is output by the target course calculating unit 10 changed gradually toward the set course $\theta_S$. For this reason, when, for example, the set course $\theta_S$ is greatly changed due to the user changing the settings, the difference between the target course $\theta_0$ and the set course $\theta_S$ becomes temporarily large. Therefore, the traveling state determination section 27 determines that the hull 1 is in a turning state when the absolute value of the difference between the target course $\theta_0$ and the set course $\theta_S$ becomes greater than or equal to a prescribed turning determination threshold value (when the set course $\theta_S$ is greatly changed).

On the other hand, if the absolute value of the difference between the target course $\theta_0$ and the set course $\theta_S$ becomes less than the prescribed turning determination threshold value, a determination can be made that the set course $\theta_S$ has not been greatly changed or that a certain amount of time has elapsed since the set course $\theta_S$ was changed. Therefore, in this case, a determination can be made that the hull 1 is in a straight traveling state (or a state close to traveling straight). Therefore, the traveling state determination section 27 is configured to determine that the hull 1 is in a straight traveling state when the absolute value of the difference between the target course $\theta_0$ and the set course $\theta_S$ is less than the prescribed turning determination threshold value.

The traveling state determination section 27 outputs a rudder angle keep determination request to the rudder angle keep command section 28 when a determination has been made that the hull 1 is traveling in a straight state. The rudder angle keep command section 28 is configured to determine whether the target rudder angle was changed to a direction that turns the rudder forward or to a direction that turns the rudder back by comparing the newest target rudder angle $\delta_{new}$ that is output by the target rudder angle calculating unit 20 or the target rudder angle $\delta_{prev}$ at the time of the previous steering command that is stored in the target rudder angle storage unit 24.

Figure 3A:
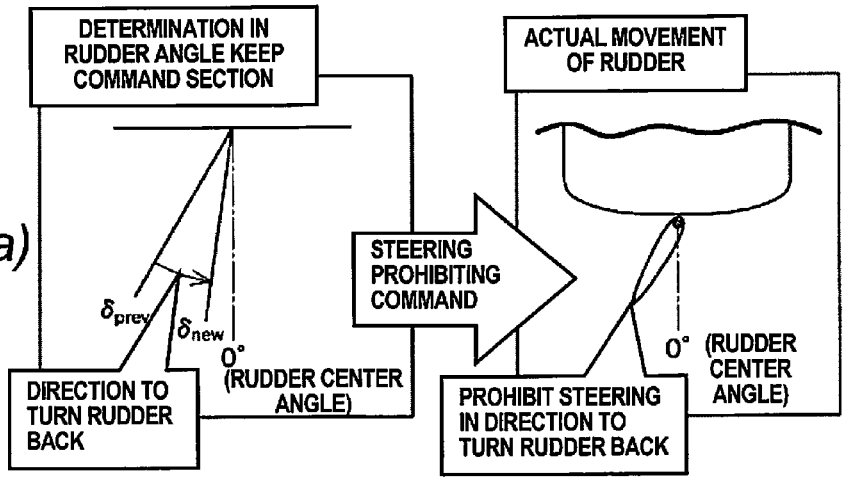
FIG. 3(*a*) is a diagram explaining the effect of a steering prohibiting command by the rudder angle keep command section.
Figure 3B:
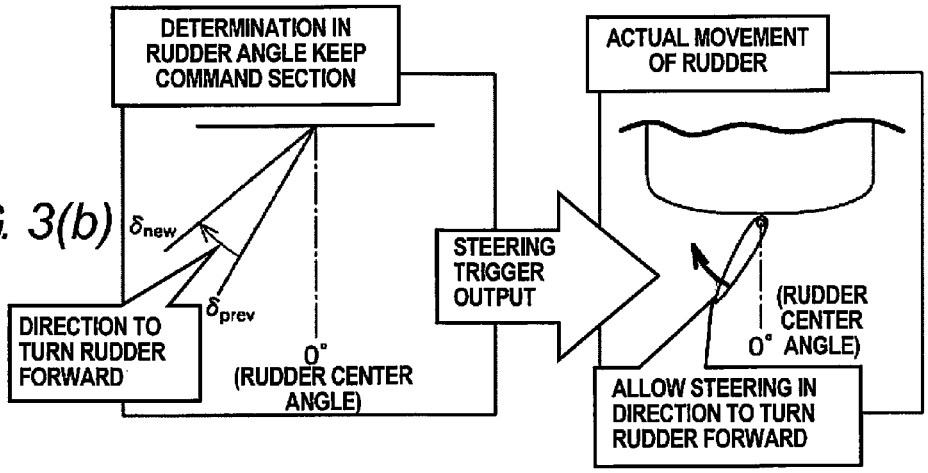
Figure 3C:
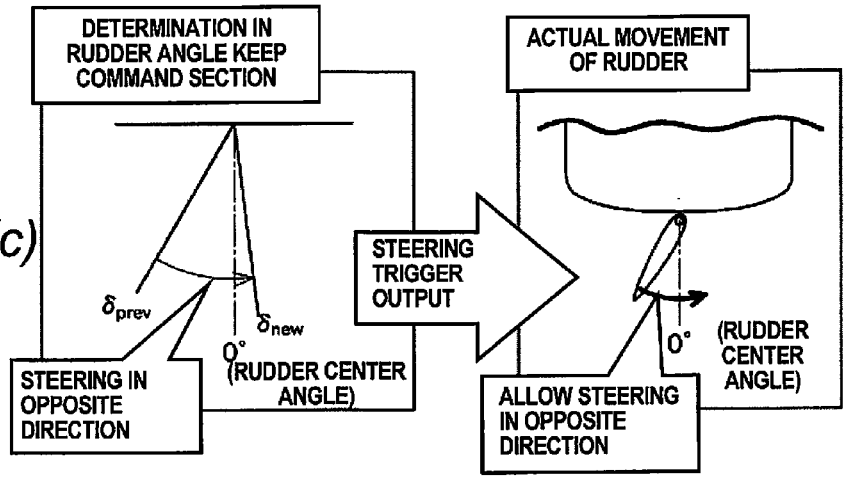

The rudder angle keep command section 28 outputs a steering prohibiting command to the steering trigger output unit 25 when a determination has been made that the target rudder angle is changing in a direction that turns the rudder back. The steering trigger output unit 25 is configured so as to not output a steering trigger during when a steering prohibiting command is being received. With the above configuration, the driving of the steering 2 in the direction that turns the rudder back is prohibited when the hull 1 is in a straight traveling state (FIG. 3(*a*)).

On the other hand, if the steering is in a direction that turns the rudder forward, the problem that "the rudder will go past the rudder center angle and the rudder will be turned to the opposite side" will not occur. Therefore, even if the hull 1 is in the straight traveling state, if the steering is in a direction that turns the rudder forward, this can be permitted without any problems. Therefore, the rudder angle keep command section 28 will not output a steering prohibiting command to the steering trigger output unit 25 when a determination has been made that the target rudder angle is changing in a direction that turns the rudder forward (that is, the rudder angle keep command section 28 will permit the output of a steering trigger in a direction that turns the rudder forward). With this, even if the ship is in a straight traveling state, steering in the direction that turns the rudder forward can be conducted as usual (FIG. 3(*b*)).

As described above, prohibiting the unnecessary turning of the rudder as much as possible while the hull 1 is in the straight traveling state is preferable. In contrast, while the hull 1 is turning, the rudder is distanced a certain degree from the rudder center angle (the rudder is at a certain angle from the rudder center angle) so that, even if the rudder is more or less turned back, the risk that the rudder will go past the rudder center angle and that the rudder will be turned to the opposite side is small. In other words, if the hull 1 is turning, the risk that unnecessary turning of the rudder will occur is small. Additionally, if the rudder is prohibited from turning back when turned too far during turning, the hull 1 will continue to turn in a state in which the rudder is turned too far and the turning speed will become too fast, so that the overshoot amount becomes too large. Therefore, in the present embodiment, the configuration is such that an output of a steering trigger in the direction to turn back the rudder is permitted when the hull 1 is turning.

This is specifically described below. The traveling state determination section 27 is configured to stop the output of a rudder angle keep determination request to the rudder angle keep command section 28 when a determination is made that the hull 1 is in a turning state. With this, the rudder angle keep command section 28 will cease to output a steering prohibiting command (that is, the output of a steering trigger in the direction to turn back the rudder will be permitted).

In this way, according to the configuration of the present embodiment, the prohibition of a steering trigger in the direction to turn back the rudder will be released when the hull 1 is turning, and turning back of the rudder will be permitted. With this, the rudder can controlled so as to be turned back if turned too far, allowing the rudder to be appropriately controlled so that overshooting will not occur.

Meanwhile, what has been explained above is a process to prevent the rudder from being turned past the rudder center angle to the opposite side, even though a target rudder angle is being output with the aim to bring the rudder closer to the rudder center angle (unnecessary turning of the rudder). On the other hand, in the case that a target rudder angle is output with turning the rudder past the rudder center angle to the opposite side as the very aim, turning the rudder past the rudder center angle to the opposite side suits the original purpose, in which case permitting steering is preferable.

Therefore, the rudder angle keep command section 28 is configured to determine whether or not the newest target rudder angle $\delta_{new}$ and the target rudder angle $\delta_{prev}$ at the time of the previous steering command are on the same side with respect to the rudder center angle. When the rudder angle keep command section 28 determines that newest target rudder angle $\delta_{new}$ and target rudder angle $\delta_{prev}$ at the time of the previous steering command are on opposite sides (when the target rudder angle is changed to turn the rudder to the reverse side), a steering prohibiting command will not be output to the steering trigger output unit 25. According to the above, even if the hull 1 is in a straight traveling state, the rudder can be turned to the opposite direction (FIG. 3(*c*)).

Next, the configuration to adjust the steering driving time in the automatic steering device 5 of the present embodiment will be explained.

In a ship during navigation, there are cases when moving the rudder temporarily becomes difficult (the movement becomes dull) due to reasons such as waves hitting the rudder. Even in these cases, a conventional automatic steering device 101 comprising a rudder angle sensor 4 can check whether or not the rudder angle is at the desired angle with the rudder angle sensor, so that this will not be a particular problem.

However, the automatic steering device 5 of the present embodiment is configured to drive the steering 2 for a short period of time in a pulsed manner for every steering trigger. In this configuration, there are cases when the rudder will not move if the steering 2 is driven for only a short period of time, when moving the rudder is difficult due to the effects of the waves, etc. In these cases, the rudder will not move, regardless of how many times a steering trigger is output, so control cannot be achieved as expected. Moreover, the automatic steering system of the present embodiment does not comprise a rudder angle sensor, so there is no means to directly check whether or not the rudder actually moved.

Therefore, the automatic steering device 5 of the present embodiment comprises a steering check unit 29 and a steering driving time temporary adjustment unit 30.

Figure 4A:
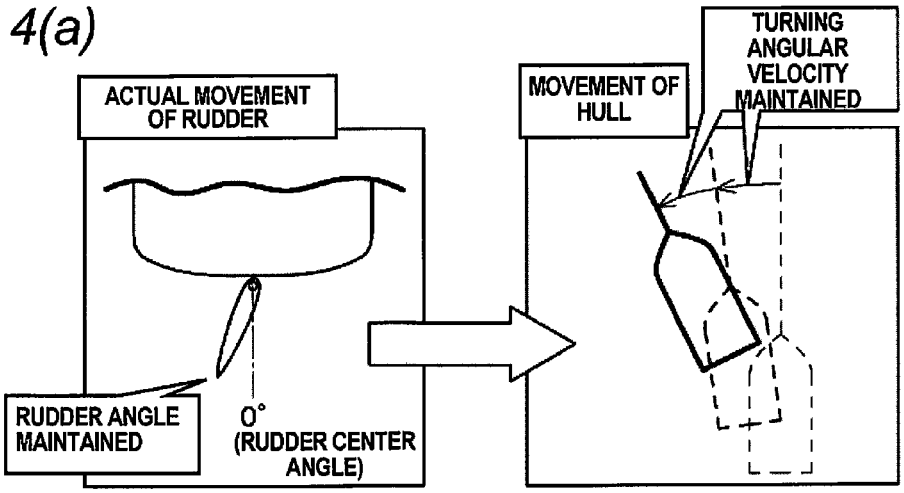
FIG. 4(*a*) is a diagram explaining how the turning angular velocity changes due to steering.
Figure 4B:
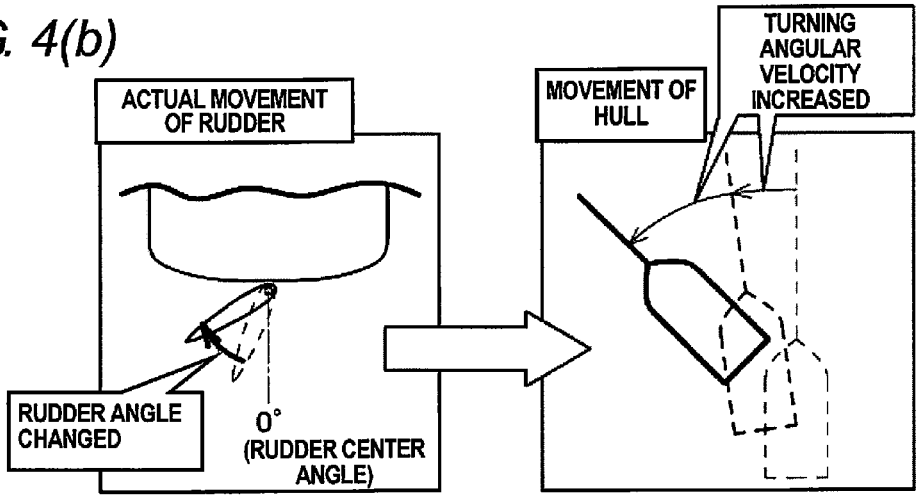

The steering check unit 29 is configured to determine whether or not the rudder has moved based on the velocity change in the heading θ that is output by the direction sensor 3. That is, in the case that the rudder angle is maintained to be constant, the hull 1 will turn at a constant turning speed, so that the heading θ that is detected by the direction sensor 3 will change at a constant speed (FIG. 4(*a*)). Meanwhile, the speed, with which the heading θ changes, is called the turning angular velocity. In the case that the rudder angle changes while turning, the turning angular velocity will also change (FIG. 4(*b*)). Therefore, by looking at the change in the turning angular velocity, a determination can be made as to whether or not the rudder has actually moved and steering was achieved.

Therefore, the steering check unit 29 is configured to detect whether or not the turning angular velocity has changed more than a prescribed threshold value within a set period of time after a steering trigger in the case that a steering trigger was output from the steering trigger output unit 25. The steering check unit 29 determines that the rudder is moving as expected and that steering is being carried out normally when the change in the turning angular velocity is greater than or equal to a prescribed threshold value. On the other hand, in the case that the change in the turning angular velocity is less than the prescribed threshold value, the steering check unit 29 will determine that the rudder is not moving as expected and that steering has not been conducted.

The steering driving time temporary adjustment unit 30 is configured to adjust the steering driving time based on the determination results of the steering check unit 29. That is, in the case that a determination has been made that the rudder is not moving, this means that the current steering driving time is too short to move the rudder. Therefore, the steering driving time temporary adjustment unit 30 will set the steering drive processing unit 26 so as to increase the steering driving time. The steering drive processing unit 26 will output a steering command so that the steering will be driven during the newly set steering driving time when a steering trigger is received after this time. On the other hand, in the case that a determination is made that the rudder is moving as expected, the steering driving time temporary adjustment unit 30 does not have to do anything in particular.

With a configuration as described above, when the rudder does not move for some reason, the steering driving time can be increased in order to more strongly turn the rudder. With this, the rudder angle can be changed even if moving the rudder has become temporarily difficult due to the effects of waves, etc.

Meanwhile, the rudder not moving due to the effects of waves, etc., is normally a temporary phenomenon. Therefore, the steering driving time temporary adjustment unit 30 will set the steering drive processing unit 26 to revert back the steering driving time when a prescribed condition has been met after increasing the steering driving time, such as a set period of time having elapsed. According to this, the steering driving time being prolonged indefinitely can be prevented.

Additionally, in an actual steering 2, there are cases in which the movement of the rudder will be slightly different when steering to the right and steering to the left due to individual differences in the rudder driving mechanism (the hydraulic cylinder, etc.) for driving the rudder. Even in these cases, a conventional automatic steering device 101 comprising a rudder angle sensor 4 can check whether or not the rudder angle is at the desired angle with the rudder angle sensor, so that this will not be a particular problem.

However, the automatic steering device 5 of the present embodiment does not comprise a rudder angle sensor, so the device cannot directly check the angle to which the rudder has moved to the left or right. For this reason, even if the movement of the rudder is slightly different when steering to the right and steering to the left, due to individual differences in the rudder driving mechanism (the hydraulic cylinder, etc.) for driving the rudder, the automatic steering device 5 cannot detect this. As a result, there are cases in which a bias occurs in the ease with which the hull 1 is turned, and the course cannot be properly controlled.

Therefore, the automatic steering device 5 of the present embodiment comprises a left-right balance detection unit 31 and a left-right balance adjustment unit 32.

Figure 5:
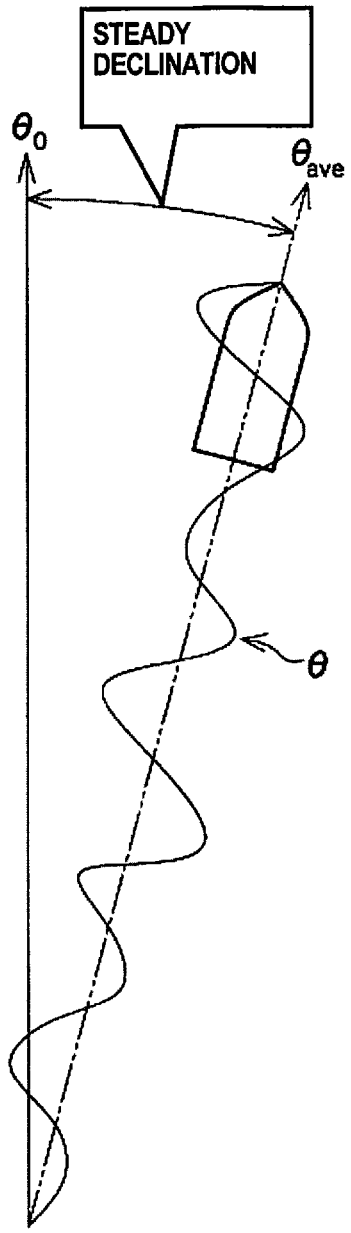
FIG. 5 is a diagram explaining a state in which a steady declination is generated.

The left-right balance detection unit 31 is configured to detect the bias in the steering amount to the left and the right based on the average value of the heading θ and the target course $\theta_0$. That is, since the hull 1 will oscillate due to the effects of the waves and the wind (yawing), as shown in FIG. 5, the heading θ will constantly fluctuate. If control of the steering 2 is being conducted normally by the automatic steering device 5 of the present embodiment, the average value of the heading θ per a plurality of instances of yawing should match the target course $\theta_0$. Here, the average value of the heading θ per a plurality of instances of yawing shall be called the heading center $\theta_{ave}$.

In the case that there is a bias in the steering amount to the left and the right of the steering 2, with the control by the automatic steering device 5 of the present embodiment, a steady misalignment (a steady declination) will be generated between the heading center $\theta_{ave}$ and the target course $\theta_0$. For example, in the case that the steering amount per one steering trigger is larger in the right direction than to the left direction, as shown in FIG. 5, the heading center $\theta_{ave}$ will shift to the right side of the target course $\theta_0$. Conversely, the bias in the steering amount to the left and the right can be detected by detecting the shift (a steady declination) between the heading center $\theta_{ave}$ and the target course $\theta_0$.

Therefore, the left-right balance detection unit 31 is configured so that an average value (a heading center $\theta_{ave}$) of the heading θ per a plurality of instances of yawing (bow oscillation) is calculated and so that the bias in the steering amount to the left and to the right will be detected based on the shift (a steady declination) between this heading center $\theta_{ave}$ and target course $\theta_0$. That is, in the case that the steady declination is constrained to a prescribed range centered around zero, the left-right balance detection unit 31 determines that the left and right steering amounts are equivalent. On the other hand, in the case that the heading center $\theta_{ave}$ is shifted to the right of the target course $\theta_0$ exceeding the prescribed range, the left-right balance detection unit 31 will determine that the steering amount in the right direction is larger than the steering amount in the left direction. In the same way, in the case that the heading center $\theta_{ave}$ is shifted to the left of the target course $\theta_0$ exceeding the prescribed range, the left-right balance detection unit 31 will determine that the steering amount in the left direction is larger than the steering amount in the right direction.

The left-right balance adjusting unit 32 adjusts the steering driving time when steering to the right and the steering driving time when steering to the left based on the determination results of the left-right balance detection unit 31. That is, when a determination has been made that the steering amount in the right direction is larger than the steering amount in the left direction, the left-right balance adjustment unit 32 will set the steering drive processing unit 26 to shorten the steering driving time when steering the rudder to the right or to lengthen the steering driving time when steering to the left. In the same way, when a determination is made that the steering amount in the left direction is larger than the steering amount in the right direction, the left-right balance adjustment unit 32 will set the steering drive processing unit 26 to shorten the steering driving time when steering to the left or to lengthen the steering driving time when steering to the right. On the other hand, when a determination is made that the steering amounts to the left and right are equivalent, the left-right balance adjustment unit 32 does not have to do anything in particular.

With a configuration as described above, even when there is a bias in the steering amount to the left and the right per one steering trigger due to individual differences in the steering 2, the bias in the steering amount to the left and the right can be resolved by reducing the steering driving time when steering to the stronger side or by increasing the steering driving time when steering to the weaker side. Meanwhile, the left-right balance adjustment unit 32 is configured to carry out the adjustment to increase the steering driving time and the adjustment to decrease this time alternately. For example, when the left-right balance adjustment unit 32 carries out an adjustment to lengthen the steering driving time when steering to the right, next, an adjustment will be made so that the steering driving time when steering to the left is shortened. In this way, by making an adjustment so as to alternately increase and decrease the steering driving time, the steering driving time being prolonged indefinitely (or shortened indefinitely) due to repeated adjustments can be suppressed.

As described above, the automatic steering device 5 comprises a target rudder angle calculating unit 20, a target rudder angle storage unit 24, and a steering command unit 23. A target rudder angle calculating unit 20 calculates the target rudder angle of the steering 2 based on a heading $\theta$ and a target course $\theta_0$. The target rudder angle storage unit 24 stores the target rudder angle $\delta_{prev}$ at the time of the previous steering command. The steering command unit 23 outputs a steering command for instructing the steering 2 to steer based on the newest target rudder angle $\delta_{new}$ calculated by the target rudder angle calculating unit 20, as well as the target rudder angle $\delta_{prev}$ at the time of the previous steering command that is stored by the target rudder angle storage unit 24.

In this way, by referring to the newest target rudder angle $\delta_{new}$ and the target rudder angle $\delta_{prev}$ at the time of the previous steering command, how the target rudder angle has changed can be known. Also, in the case that the target rudder angle has not changed, a determination can be made that changing the rudder angle is not necessary; in the case that the target rudder angle has changed, a determination can be made that steering is necessary. Therefore, by controlling the steering 2 based on this, an automatic steering control can be realized without detecting the current rudder angle with a rudder angle sensor.

Figure 6:
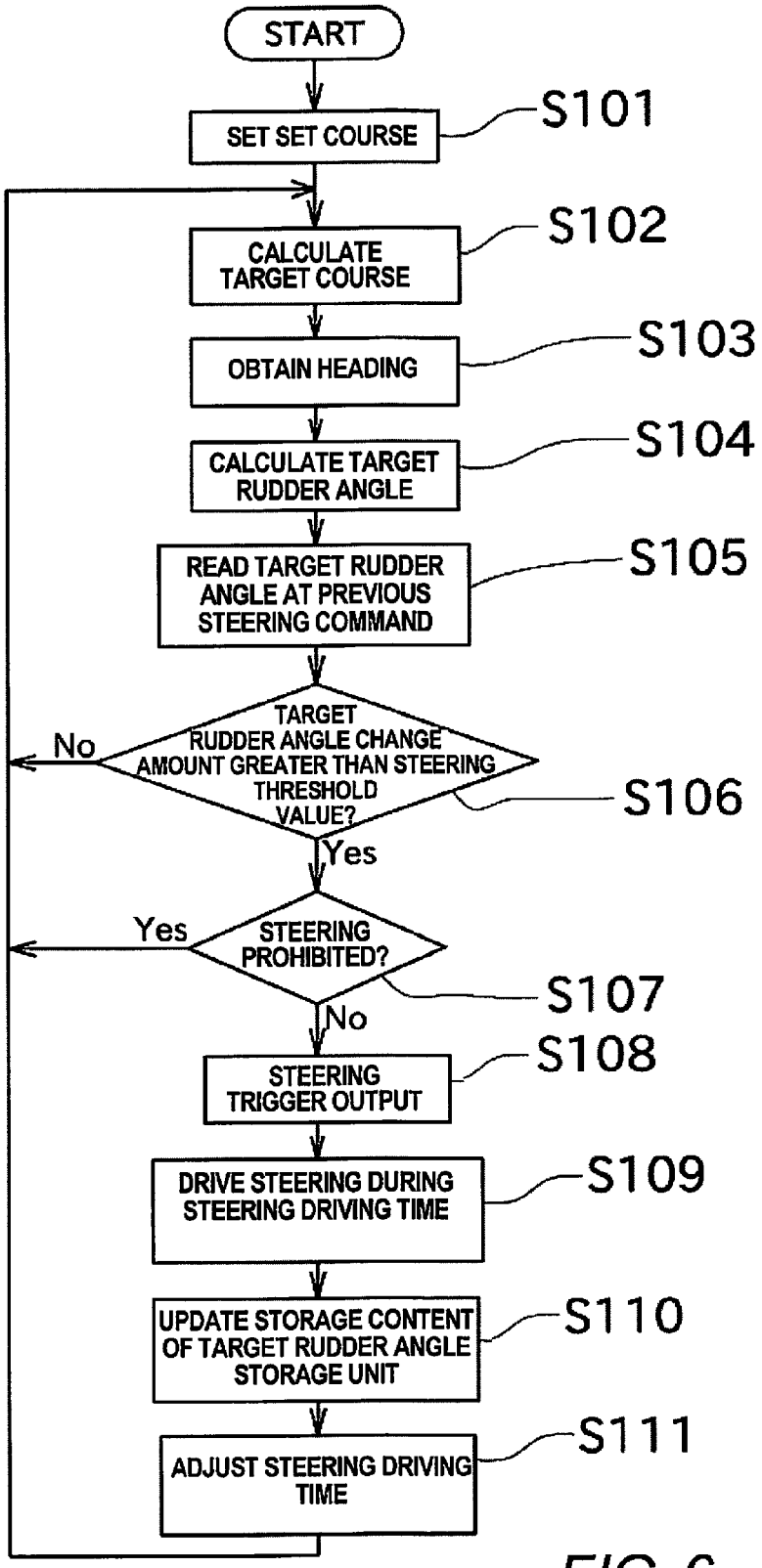
FIG. 6 is a flow chart for an automatic steering method according to one embodiment of the present invention.

Next, the automatic steering method according to the automatic steering device 5 described above will be explained with reference to the flowchart in FIG. 6.

First, the set course $\theta_S$ is set (Step S101). As mentioned above, the set course $\theta_S$ can be manually set by the user or automatically by a navigation device, etc. Next, the target course calculating unit 10 calculates the target course $\theta_0$ based on the set course $\theta_S$ that is set (Step S102).

Then, the heading $\theta$ is detected by the direction sensor 3 (Step S103). The target rudder angle calculating unit 20 calculates the newest target rudder angle $\delta_{new}$ based on the detected heading $\theta$ and the target course $\theta_0$ (Step S104, the target rudder angle calculating step).

In Step S105, the steering command unit 23, reads the target rudder angle $\delta_{prev}$ at the time of the previous steering command from the target rudder angle storage unit 24 (the previous target rudder angle obtaining step). Then, the steering command unit 23 will output a steering command to the steering 2 based on the newest target rudder angle $\delta_{new}$ and the target rudder angle $\delta_{prev}$ at the time of the previous steering command (Steps S106 to S110, the steering command step).

The steering command step will be explained in detail. First, the steering trigger output unit 25 determines whether or not to output a steering trigger in response to the target rudder angle change amount $\delta_{chg}$ (Step S106). The steering trigger output unit 25 will output a steering trigger if the target rudder angle change amount $\delta_{chg}$ is greater than or equal to a steering threshold value (Step S108, the steering trigger output step). However, in the case that the rudder angle keep command section 28 is prohibiting the steering trigger (a determination of Step S107), the steering trigger output unit 25 will not output a steering trigger in the direction to turn the rudder back. Additionally, if the target rudder angle change amount $\delta_{chg}$ is less than the steering threshold value, a steering trigger will not be output, and the process returns to Step S102.

If the steering trigger is output, the steering drive processing unit 26 will output a steering command to the steering 2 during a prescribed steering driving time (Step S109, the steering driving process step). Also, if the above-described steering trigger is output, the target rudder angle storage unit 24 will update the value of the target rudder angle that has been stored with the newest target rudder angle $\delta_{new}$ (Step S110, the target rudder angle storage step).

Finally, if necessary, the steering driving time is adjusted by the steering driving time temporary adjustment unit 30 and the left-right balance adjustment unit 32 (Step S111). Then, the process returns to Step S102, and the above-described steps are repeated.

As explained above, the automatic steering method of the present embodiment comprises a target rudder angle calculating step, a previous target rudder angle obtaining step, and a steering command step. In the target rudder angle calculating step, (Step S104), the target rudder angle of the steering 2 is calculated based on the heading $\theta$ and the target course $\theta_0$. In the previous target rudder angle obtaining step (Step S105), the target rudder angle $\delta_{prev}$ at the time of the previous steering command is obtained. In the steering command step (Step S106 to S110), the steering command outputs steering instructions to the steering 2, based on the newest target rudder angle $\delta_{new}$ that is calculated in the target rudder angle calculating step and the target rudder angle $\delta_{prev}$ at the time of the previous steering command that is obtained in the previous target rudder angle obtaining step.

Figure 7:
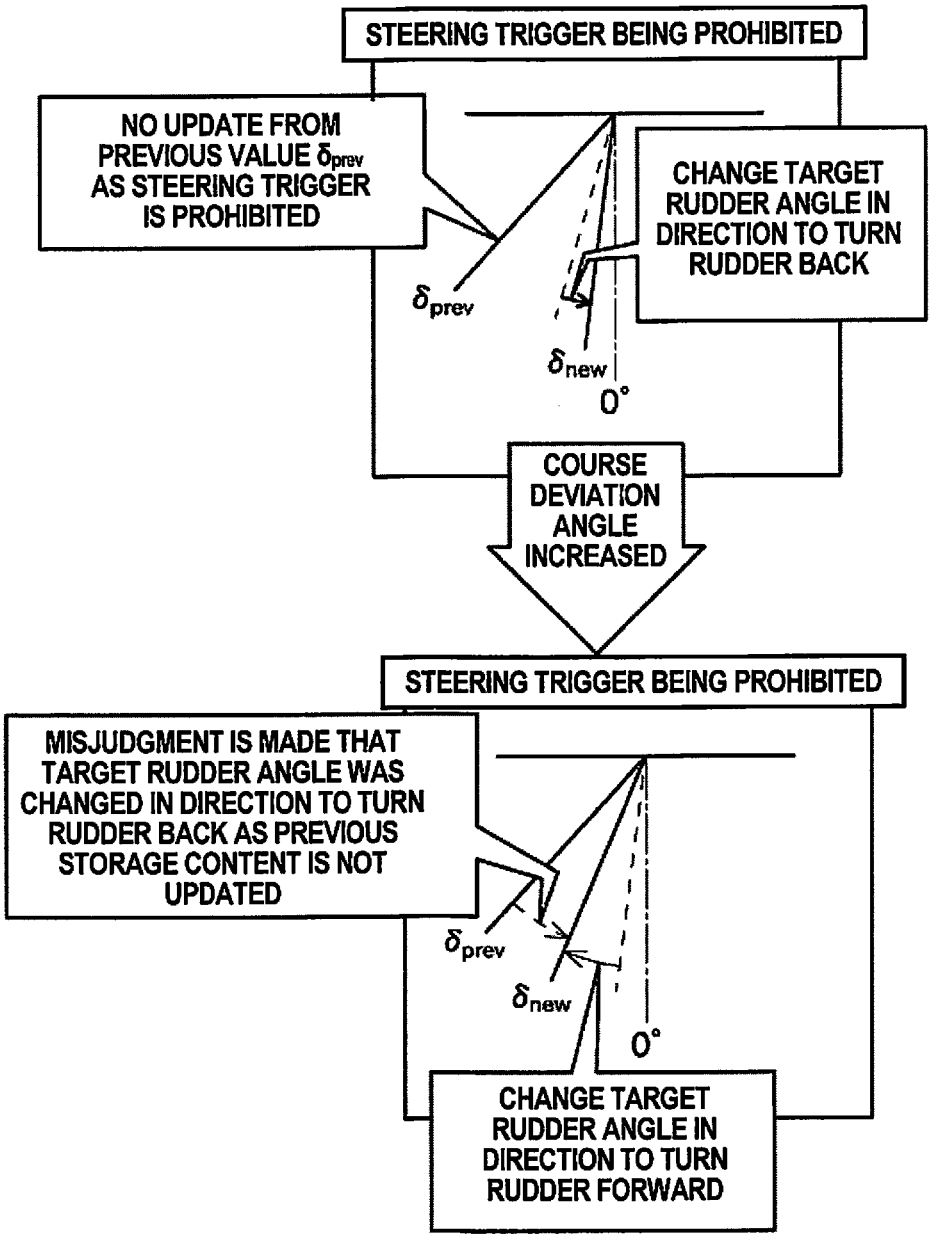
FIG. 7 is a diagram explaining the storage contents of the target rudder angle storage unit when a steering trigger is prohibited.

Next, a modified example of the present embodiment will be explained with reference to FIG. 7 and FIG. 8. Meanwhile, the configurations that are the same or similar to the above-described embodiment will be given the same reference symbols for the element names and drawings, and their explanations have been omitted.

In the above-described embodiment, the storage content of the target rudder angle storage unit 24 was updated by the newest target rudder angle $\delta_{new}$ when the steering trigger has been output from the steering trigger output unit 25. However, in the above-described embodiment, since a steering trigger will not be input into the target rudder angle storage unit 24 while the steering trigger is prohibited by the rudder angle keep command section 28, the storage content of the target rudder angle storage unit 24 will not be updated (FIG. 7).

Even while the hull 1 is traveling straight, there are cases in which the misalignment between the heading $\theta$ and the target course $\theta_0$ (the course deviation angle $\Delta\theta$) will become large due to the effects of an external disturbance like waves and wind or due to unforeseen causes, such as the steering 2 not driving. In such cases, the target rudder angle that is calculated by the target rudder angle calculating unit 20 is changed to the direction to turn the rudder forward, so as to resolve the course deviation angle $\Delta\theta$ (FIG. 7). Therefore, when the course deviation angle $\Delta\theta$ increases due to unforeseen causes, the rudder angle is preferably changed to a direction to turn the rudder forward to eliminate the course deviation angle $\Delta\theta$ in the early stages.

However, in the configuration of the above-described embodiment, there are cases in which an error occurs in the determination of the direction to which the target rudder angle changed at the rudder angle keep command section 28 while the steering trigger is being prohibited. For example, as shown in the lower of FIG. 7, there are cases in which a determination is mistakenly made that the target rudder angle was changed in a direction to turn the rudder back, even though the target rudder angle was changed in a direction to turn the rudder forward. The cause for this misjudgment is that the storage content of the target rudder angle storage unit 24 has not been updated (the storage content is dated). If a misjudgment like the above occurs, an appropriate steering command cannot be output to the steering 2, so the course deviation angle $\Delta\theta$ cannot be resolved quickly.

Figure 8:
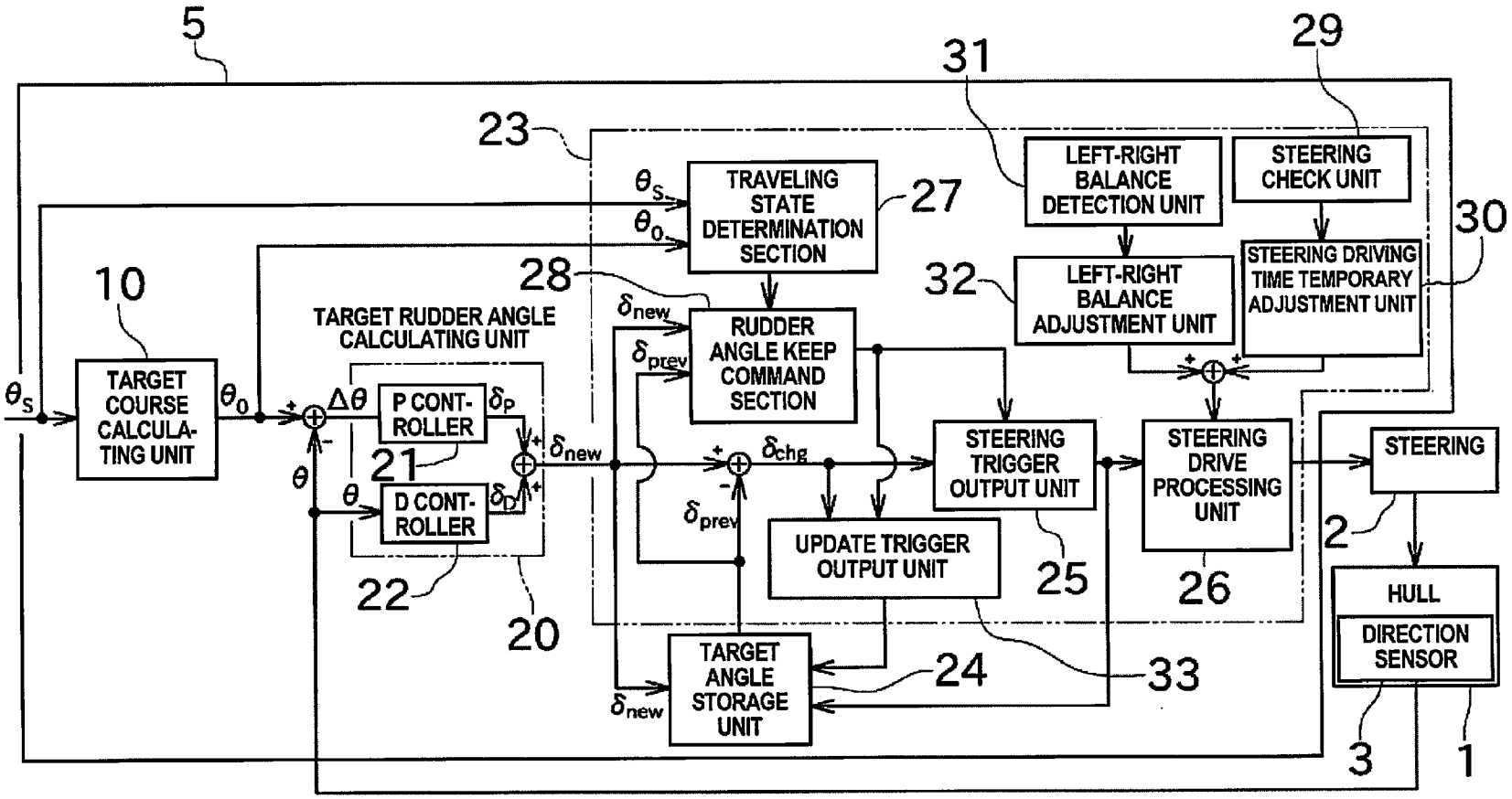
FIG. 8 is a block diagram showing a configuration of the automatic steering system comprising the automatic steering device according to a modified example.

Therefore, the automatic steering device 50 of the present modified example comprises an update trigger output unit 33, as shown in FIG. 8. This update trigger output unit 33 is configured to output an update trigger to the target rudder angle storage unit 24 when the steering trigger is being prohibited by the rudder angle keep command section 28. When an update trigger is input, the target rudder angle storage unit 24 will update the storage content with the newest target rudder angle $\delta_{new}$ that is output by the target rudder angle calculating unit 20. With this, even when the steering trigger is prohibited, the storage content of the target rudder angle storage unit 24 can be updated.

In this way, according to the configuration of the present modified example, since the storage content of the target rudder angle storage unit 24 can be constantly updated, the rudder angle keep command section 28 can accurately determine the direction to which the target rudder angle has changed (if the change occurred in a direction to turn the rudder forward or if the change occurred in the direction to turn the rudder back). With this, the rudder angle keep command section 28 can release the steering prohibiting command and output a steering command when the target rudder angle has changed in the direction to turn the rudder forward. Therefore, when the course deviation angle $\Delta\theta$ increases due to unforeseen causes while the hull 1 is traveling straight, the rudder angle can be changed to a direction to turn the rudder forward to eliminate the course deviation angle $\Delta\theta$ in the early stages.

A preferred embodiment and a modified example of the present invention have been explained above, but the above-described configuration can be changed in the following way.

The automatic steering device of the present invention is not limited to controlling the rudder of a ship and can be utilized for controlling the steering of other movable bodies, such as airplanes.

In the above-described embodiment, the device was configured so that a steering command is output only during the steering driving time in response to a steering trigger, but the device is not limited to this configuration. The biggest feature of the present invention is carrying out an automatic steering control based on the newest target rudder angle and the target rudder angle at the time of the previous steering. Therefore, how the steering command is output (the configuration to output a steering command only during the steering driving time in response to a steering trigger) can be appropriately omitted or changed.

The automatic steering device 5 can be configured as a computer comprising hardware such as a CPU, a ROM, and a RAW. Also, with the above-described hardware and software (a program to control the automatic steering device) working in cooperation, each function of automatic steering device 5 (the function of the target course calculating unit 10, the function of the target rudder angle calculating unit 20, the function of the steering command unit 23, etc.) can be realized. Additionally, the automatic steering device 5 can be configured with a general-purpose computer, and this device can also be configured to realize each function of the automatic steering device 5 with dedicated hardware.

In the above-described embodiment, the traveling state determination section 27 was configured to determine the traveling state of the hull 1 based on the difference between the set course $\theta_S$ and the target course $\theta_0$. However, for the method to determine the traveling state of the hull 1, other appropriate methods can be employed. For example, the traveling state determination section 27 can determine the traveling state of a ship based on the course deviation angle $\Delta\theta$. In other words, if the absolute value of the course deviation angle $\Delta\theta$ is less than a prescribed determination threshold value, this means that the heading $\theta$ is matching the target course $\theta_0$ to a certain degree, so that a determination can be made that the hull 1 is close to a straight traveling state. Additionally, in the case that the absolute value of the course deviation angle $\Delta\theta$ is greater than or equal to the determination threshold value, since there is a shift between the heading $\theta$ and the target course $\theta_0$, a determination can be made that the turning the hull 1 is in progress so as to resolve the shift.

The invention claimed is:

1. An automatic steering device comprising:

a target rudder angle calculating controller configured to calculate a target rudder angle of a steering based on a heading and a target course of a movable body;

a target rudder angle storage configured to store the target rudder angle at a time of a previous steering command; and a computer configured to control a pulse width of a steering command which instructs the steering to steer based on a newest target rudder angle calculated by the target rudder angle calculating controller and the target rudder angle at the time of the previous steering command stored by the target rudder angle storage, and to control a time at which the steering command is output;

the computer being configured not to output the steering command when the target rudder angle change amount, which is a difference between the newest target rudder angle and the target rudder angle at the time of the previous steering command, is less than a prescribed steering threshold value;

the computer being configured to output a steering trigger when the target rudder angle change amount is greater than or equal to the steering threshold value, and output the steering command so as to drive the steering during a prescribed steering driving time in response to the steering trigger; and the computer being configured to detect whether or not a rudder has moved based on a change in a turning angular velocity of the movable body, and temporarily increase the steering driving time when the rudder is not moving even though the steering trigger has been output.

2. The automatic steering device according to claim 1, wherein the target rudder angle storage is configured to update storage content to the newest target rudder angle in response to the steering trigger.

3. The automatic steering device according to claim 1, wherein the computer is further configured to prohibit an output of a steering trigger to turn a rudder back from a direction of the steering.

4. The automatic steering device according to claim 3, wherein the computer is further configured to output an updated trigger when the steering trigger is prohibited to turn the rudder back from the direction of the steering by the rudder angle keep command section, and the target rudder angle storage is further configured to update storage content to the newest target rudder angle in response to the update trigger.

5. The automatic steering device according to claim 3, wherein the computer is further configured to determine whether or not a traveling state of the movable body is in a straight traveling state, and prohibit the output of the steering trigger to turn the rudder back from the direction of the steering when the movable body is in the straight traveling state.

6. The automatic steering device according to claim 1, wherein the computer is further configured to detect deviation of a steering amount to the left and right based on a difference between an average value of the heading of the movable body and the target course, and adjust based on the deviation when steering a rudder to the right and the steering driving time when steering the rudder to the left.

7. An automatic steering method comprising:

calculating a target rudder angle of a steering based on a heading and a target course of a movable body;

obtaining the target rudder angle at a time of a previous steering command;

selectively controlling a pulse width of a steering command which controls the steering to steer based on a newest target rudder angle and the target rudder angle at the time of the previous steering command, and selectively controlling a time at which the steering command is output, the steering command including a steering trigger which is outputted when the target rudder angle change amount is greater than or equal to the steering threshold value, and a steering driving command so as to drive the steering during a prescribed steering driving time which is outputted in response to the steering trigger;

refraining from outputting the steering command when the target rudder angle change amount, which is a difference between the newest target rudder angle and the target rudder angle at the time of the previous steering command, is less than a prescribed steering threshold value; and detecting whether or not a rudder has moved based on a change in a turning angular velocity of the movable body, and temporarily increasing the steering driving time when the rudder is not moving even though the steering trigger has been output.

* * * * *